US011678100B2

(12) United States Patent
Rajasekaran

(10) Patent No.: US 11,678,100 B2
(45) Date of Patent: Jun. 13, 2023

(54) CONTROL POD WITH DOCKING HEADSET

(71) Applicant: PLANTRONICS, INC., Santa Cruz, CA (US)

(72) Inventor: Arun Rajasekaran, Saratoga, CA (US)

(73) Assignee: PLANTRONICS, INC., Santa Cruz, CA (US)

( * ) Notice: Subject to any disclaimer, the term of this patent is extended or adjusted under 35 U.S.C. 154(b) by 0 days.

(21) Appl. No.: 17/450,265

(22) Filed: Oct. 7, 2021

(65) Prior Publication Data

US 2022/0109923 A1 Apr. 7, 2022

Related U.S. Application Data

(60) Provisional application No. 63/088,728, filed on Oct. 7, 2020.

(51) Int. Cl.
*H04R 1/02* (2006.01)
*H04R 1/10* (2006.01)

(52) U.S. Cl.
CPC ..... *H04R 1/1025* (2013.01); *H04R 1/1041* (2013.01); *H04R 1/1091* (2013.01); *H04R 2420/07* (2013.01)

(58) Field of Classification Search
CPC .. H04R 1/1008; H04R 1/1016; H04R 1/1025; H04R 1/1041; H04R 1/1091; H04R 2420/07; H04R 3/04
See application file for complete search history.

(56) References Cited

U.S. PATENT DOCUMENTS

| | | | | |
|---|---|---|---|---|
| 7,715,191 | B2 | 5/2010 | Leung | |
| 8,948,412 | B2 | 2/2015 | Lee | |
| 9,148,717 | B2 | 9/2015 | Shaffer | |
| 9,210,498 | B1 | 12/2015 | Shaffer | |
| 9,769,558 | B2 | 9/2017 | Chandramohan | |
| 9,832,560 | B1 * | 11/2017 | Bagga | H02J 7/342 |
| 10,237,642 | B2 | 3/2019 | Cheney | |
| 2007/0053544 | A1 * | 3/2007 | Jhao | H04M 1/6066 381/384 |
| 2013/0156247 | A1 * | 6/2013 | Boyajian | H04R 1/30 381/370 |
| 2017/0064431 | A1 * | 3/2017 | Lee | H04R 5/04 |
| 2017/0093079 | A1 | 3/2017 | Wagman | |
| 2017/0289668 | A1 | 10/2017 | Kim | |
| 2018/0091884 | A1 | 3/2018 | Minoo | |
| 2018/0324515 | A1 * | 11/2018 | Boesen | H04R 1/1041 |
| 2018/0367883 | A1 | 12/2018 | Minoo | |
| 2020/0336820 | A1 | 10/2020 | Tasaka | |
| 2021/0037306 | A1 | 2/2021 | Lehnert | |

OTHER PUBLICATIONS

International Search Report and Written Opinion dated Aug. 19, 2021 for International Patent Application No. PCT/US2021/070947.
Non-Final Office Action dated Jul. 12, 2021 for U.S. Appl. No. 16/987,222.

* cited by examiner

*Primary Examiner* — Jason R Kurr

(57) ABSTRACT

A wireless control pod stores a headset for charging when not in use. When the headset is in signal communication with a smart device, a user can use the wireless control pod to control one or more functions of the smart device. When the headset is docked with a secondary headset, the audio to the speakers of the headset is adjusted for broadcast by the secondary headset.

20 Claims, 14 Drawing Sheets

CONTROL POD WITH DOCKING HEADSET

CROSS-REFERENCE TO RELATED APPLICATION

This application claims priority to U.S. provisional application No. 63/088,728, filed Oct. 7, 2020, and entitled 'Control Pod with Docking Headset,' the contents of which are entirely incorporated by reference herein.

BACKGROUND

Mobile phones and small watch-like wearable devices exist which can connect wirelessly to Bluetooth™ headsets. However, line-of-sight devices like mobile phones and other smart wearable devices are usually bulky and not ideal for controlling wireless headsets. Moreover, a user may desire to use more than one type of headset in a given day. For example, a user might wish to use a set of earbuds during teleconferences but use larger headphones to stream classical music when not in teleconferences. Changing the settings (multiple times) of the streaming device (e.g., mobile phone) to switch from transmitting to the earbuds to the headphones can be a nuisance for the user. Thus, there is room for improvement in the art.

SUMMARY

One example of this disclosure is a line-of-sight device suitable for controlling one or more functions of a wireless headset.

Another example of this disclosure is a wireless control pod, comprising: one or more radios; a memory; and a processor coupled to the one or more radios and the memory, wherein the processor is operable to: communicate with a headset over a channel using at least one of the one or more radios; transmit a data stream over the channel containing audio data for broadcast by one or more speakers of the headset, the audio data based on data stored by the memory or received using at least one of the one or more radios; detect a docking connection of one or more earbuds of the headset to a secondary headset; determine audio characteristics of the secondary headset through at least one of the one or more earbuds of the headset, responsive to the detection; and adjust the data stream to adapt to the determined audio characteristics of the secondary headset to enable one or more speakers of the secondary headset to faithfully reproduce the audio data of the data stream.

Another example of this disclosure is a non-transitory computer readable medium storing instructions executable by a processor, wherein the instructions comprise instructions to: communicate with a headset over a channel using one or more radios; transmit a data stream over the channel containing audio data for broadcast by one or more speakers of the headset, the audio data based on data stored by a memory or received using at least one of the one or more radios; detect a docking connection of one or more earbuds of the headset to a secondary headset; determine audio characteristics of the secondary headset through at least one of the one or more earbuds of the headset, responsive to the detection; and adjust the data stream to adapt to the determined audio characteristics of the secondary headset to enable one or more speakers of the secondary headset to faithfully reproduce the audio data of the data stream.

Another example of this disclosure is a method of operating a wireless control pod, the method comprising: communicating with a headset over a channel using one or more radios of the wireless control pod; transmitting a data stream over the channel containing audio data for broadcast by one or more speakers of the headset; detecting a docking connection of one or more earbuds of the headset to a secondary headset; determining audio characteristics of the secondary headset through at least one of the one or more earbuds of the headset, responsive to the detection; and adjusting the data stream to adapt to the determined audio characteristics of the secondary headset to enable one or more speakers of the secondary headset to faithfully reproduce the audio data of the data stream.

Another example of this disclosure is a control pod for a wireless headset operable to enable the wireless headset to connect to a local area network or a wide area network.

Yet another example of this disclosure is a wireless control pod which provides real-time access to information about audio operations and radio operations of a wireless headset.

Another example of this disclosure is a wireless control pod, comprising: a power source; one or more radios; a memory; and a processor which is coupled to the power source, the one or more radios, and the memory. The processor is operable to: draw power from the power source; communicate with a headset over a channel using at least one of the one or more radios; transmit a data stream over the channel containing audio data for broadcast by one or more speakers of the headset, the audio data based on data stored by the memory or received using at least one of the one or more radios; detect a docking connection of one or more earbuds of the headset to a secondary headset; determine audio characteristics of the secondary headset through at least one of the one or more earbuds, responsive to the detection; and adjust the data stream to adapt to the determined audio characteristics of the secondary headset so as to enable the one or more speakers of the secondary headset to faithfully reproduce the audio data of the data stream.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

There exist earbuds which are small audio reproduction devices which include speakers of varying quality and are frequently designed to be placed in a user's ear canal. There also headphones which are frequently much larger than earbuds and are intended to be worn on the user's head and cover the user's ears. Such headphones can include larger speakers which can render higher quality audio than their earbud counterparts. There are times when a user will prefer one audio reproduction device (e.g., headphones) over another (e.g., earbuds). However, when for example, a user is wirelessly streaming data to first headset (e.g., an earbud or a pair of earbuds) and the user desires to use a second headset (e.g., larger headphones), it can be inconvenient to reconfigure a device (e.g., a wireless control pod) which is streaming audio to the first headset to begin sending audio data to the headphones.

Accordingly, the invention includes a first headset having one or more earbuds which can be docked with a second headset (headphones or a follower headset). When the earbud(s) of the first headset dock with the second, follower, headset, information (e.g., speaker volume range) about the follower headset is detected using the first headset and passed to the device streaming audio. The audio data stream is automatically adjusted to accommodate the characteristics (e.g., greater audio range) of the follower headset without further intervention by the user, thus improving the user's experience. The second headset can be considered as a follower headset in that the nature of the audio data streamed through the first headset to the follower headset is determined (at least in part) by the first headset (e.g., earbud(s)).

Figure 1A:
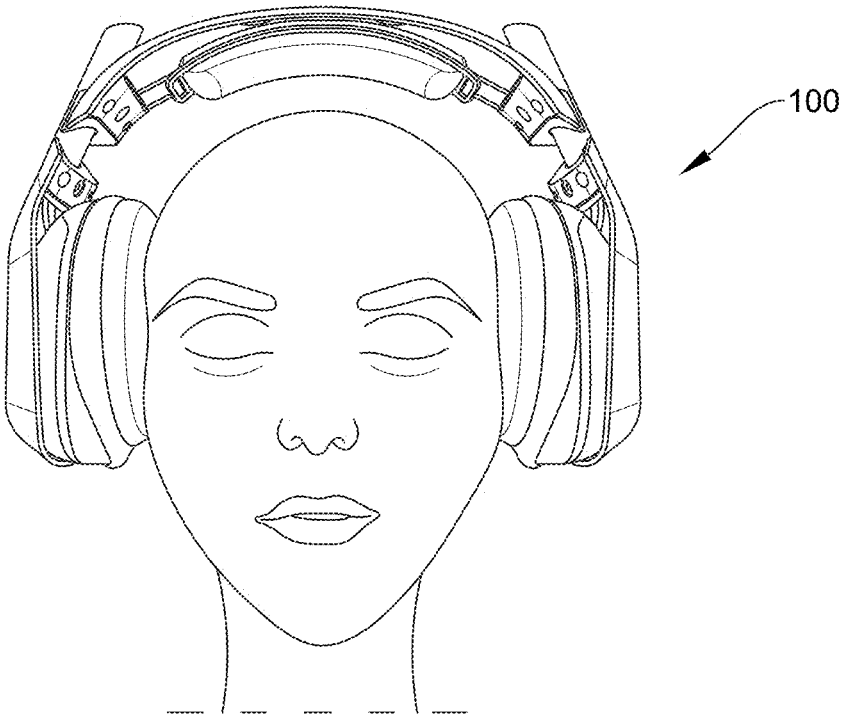
FIG. 1A illustrates a follower headset, in accordance with an example of this disclosure.

FIG. 1A illustrates a follower headset 100, in accordance with an example of this disclosure. Follower headset 100 has one or more earbud receiving areas that can receive one or more earbuds of a wireless headset. Audio output and other functions of the follower headset 100 can be driven or controlled by or through one or more such earbuds when the one or more earbuds are connected to the follower headset 100 at the earbud receiving area(s).

Figure 1B:
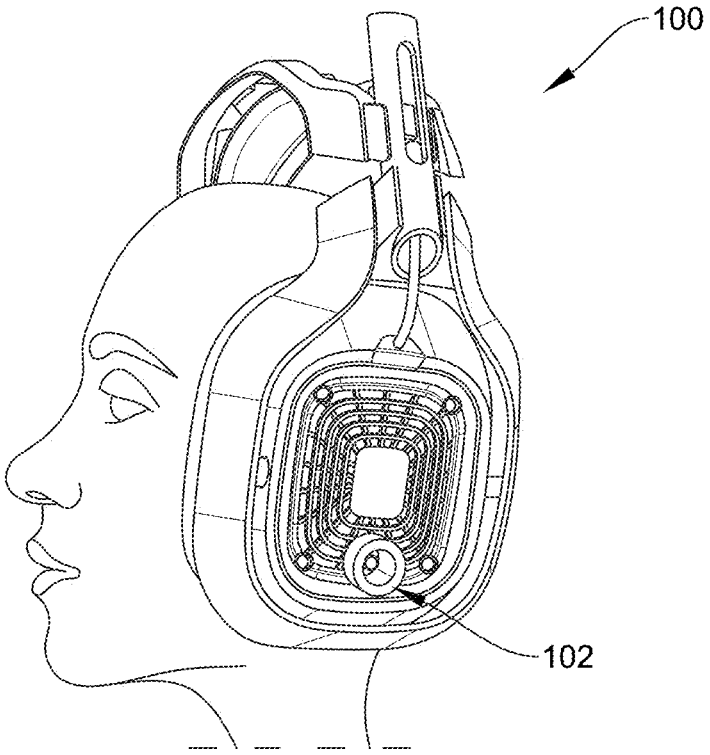
FIG. 1B illustrates a follower headset with an earbud receiving area exposed, in accordance with an example of this disclosure.

FIG. 1B illustrates a follower headset 100 with an earbud receiving area 102 exposed, in accordance with an example of this disclosure. Follower headset 100 has one or more earbud receiving areas 102 that can receive one or more wireless earbuds. Audio input, output, and other functions can be driven or controlled by or through one or more such earbuds (see e.g., 202, 206, FIGS. 2-3) when the one or more earbuds are connected to the follower headset 100 at the earbud receiving area(s). Within the earbud receiving area 102, the follower headset 100 has docking and communication mechanics, and circuitry to properly hold the earbuds and communicate with them, (see FIG. 5)

In some examples of the invention, the follower headset 100 has at least one pin used to communicatively couple with the docking earbuds. Follower headset 100 also has on-board memory (e.g., a data store) that holds all necessary information about the follower headset 100 that the earbuds need to provide an optimal audio experience. Information such as the follower headset's unique ID, type (monoaural, binaural, etc.), and audio tuning settings can be stored in the on-board memory.

Figure 2:
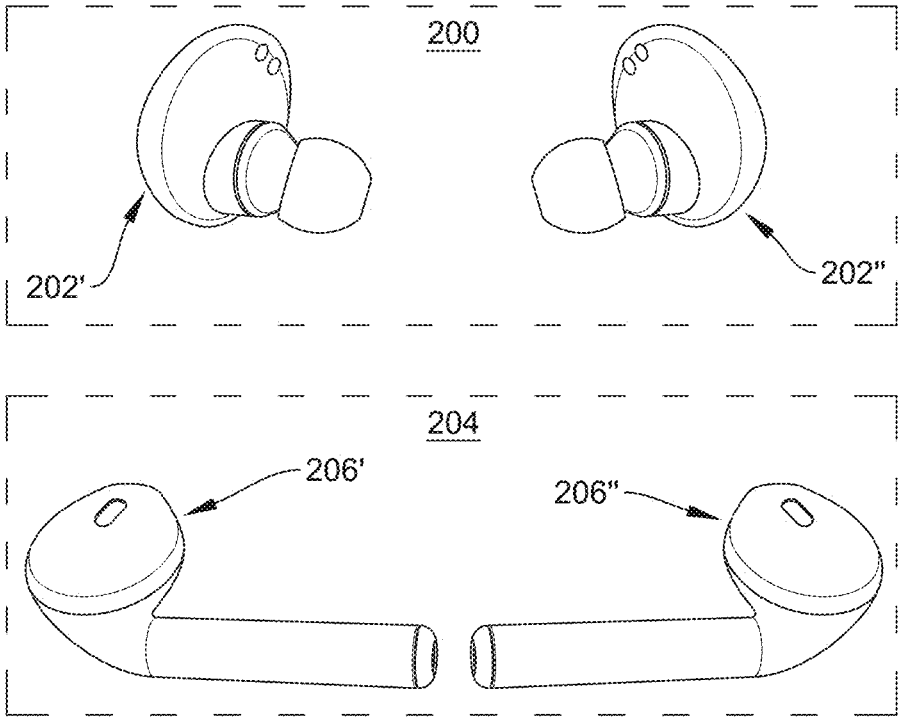
FIG. 2 illustrates two wireless headsets, each comprising two earbuds, in accordance with an example of this disclosure.

FIG. 2 illustrates a first wireless headset 200 comprising a first pair of earbuds 202, and a second wireless headset 204 comprising a second pair of earbuds 206. When one or more such earbuds 202, 206 are connected to a follower headset 100, audio output and other functions of the follower headset 100 can be driven or controlled by or through one or more earbuds 202, 206.

The earbuds 202, 206 (along with a control pod (500)) can be used in stand-alone earbuds mode or can be dock-able into various other follower headsets (e.g., 100) to provide a seamless transition from one audio experience to another. The earbuds 202, 206 can be used in various modes. In one mode, the earbuds 202, 206 are true wireless stereo (TWS) earbuds controlled by a wireless control pod (500). In another mode the earbuds 202, 206 are TWS earbuds that can be docked into an on-the-ear headset (e.g., 100) or an around-the-ear headset (not shown). The on-the-ear headset or the, around-the-ear headset can be of monoaural or binaural nature and controlled by the wireless control pod.

Figure 3:
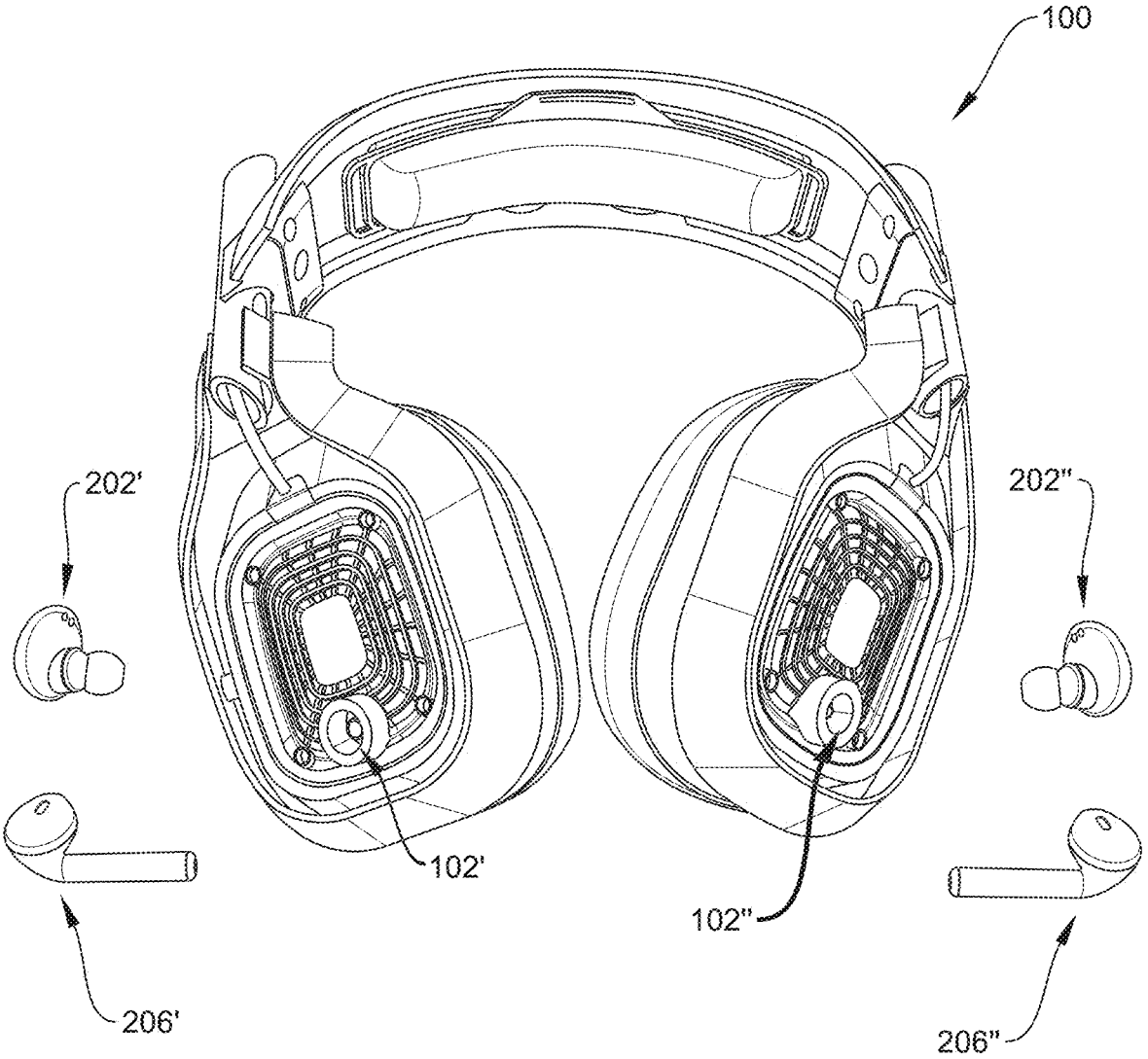
FIG. 3 illustrates a follower headset and earbuds from two other headsets, in accordance with an example of this disclosure.

FIG. 3 illustrates a follower headset 100 and earbuds 202, 206 from two other headsets. The follower headset 100 in FIG. 3 has two earbud receiving areas 102, enabling the follower headset 100 to be connected to both earbuds (e.g., 202) of one of the other headsets (e.g., 200) shown, (see FIG. 2).

Figure 4A:
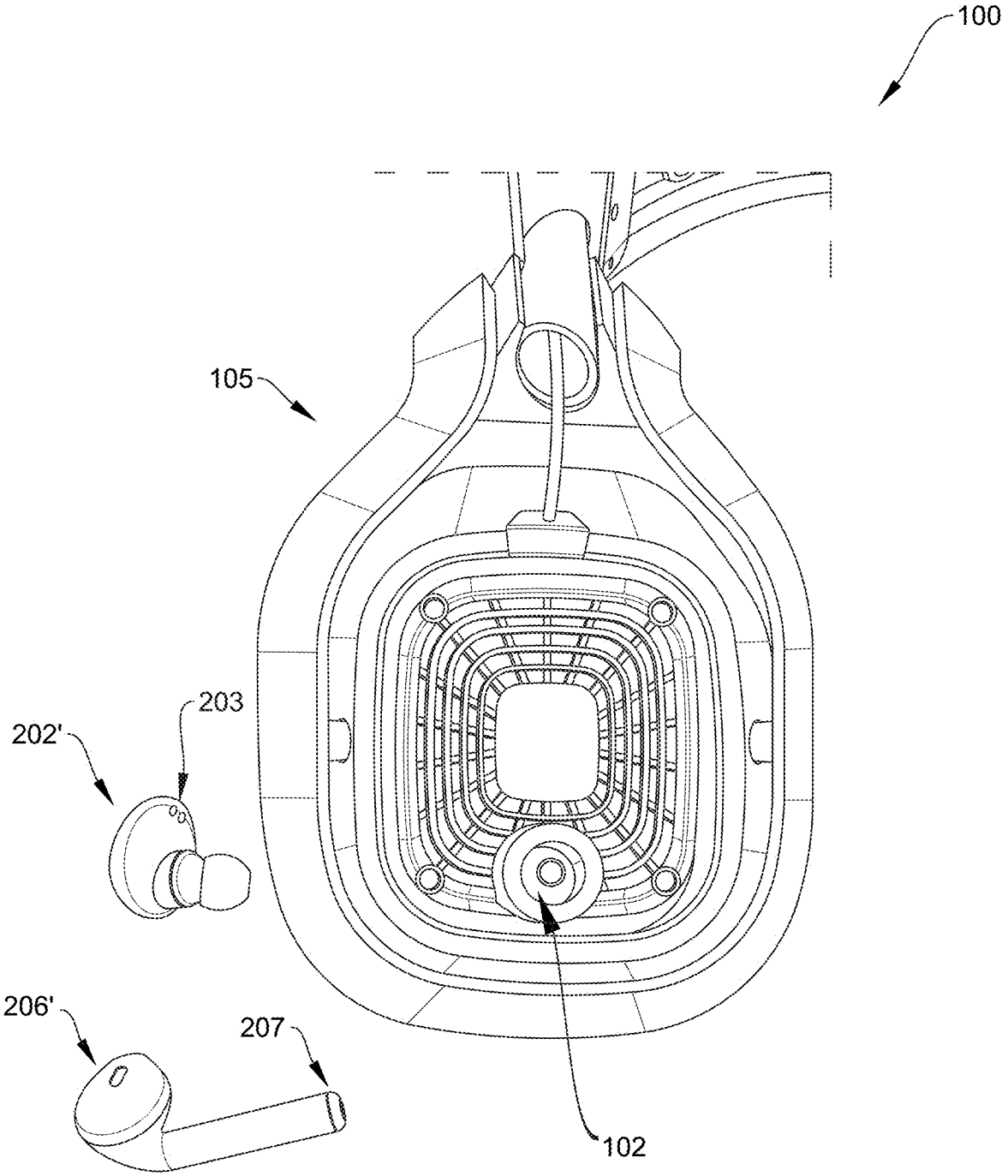
FIG. 4A shows a closeup view of an earmuff of a follower headset, in accordance with an example of this disclosure.

FIG. 4A shows a closeup view of an earmuff 105 of a follower headset 100. The earmuff 105 has a receiving area 102 into which either of the two earbuds 202', 206' can be inserted to control operation of the follower headset 100. In some examples of this disclosure, when one or more such earbuds 202', 206' are inserted into one or more receiving areas 102 of a follower (secondary) headset 100, the one or more such earbuds 202', 206' can determine audio characteristics of the follower headset 100. For example, a pin 203, 207 of an earbud 202', 206' can couple with a speaker of the headset 100. In some examples of this disclosure, an earbud 202', 206' can, based on the coupling, determine the type of speaker(s) of the follower headset 100. In at least one example, an earbud 202', 206' can, based on the coupling, transmit information concerning audio characteristics of the follower headset 100 (e.g., corresponding to the model and make of the follower headset 100) to a device (e.g., a control pod 500) which is sending audio to the earbud(s) 202', 206'.

Figure 4B:
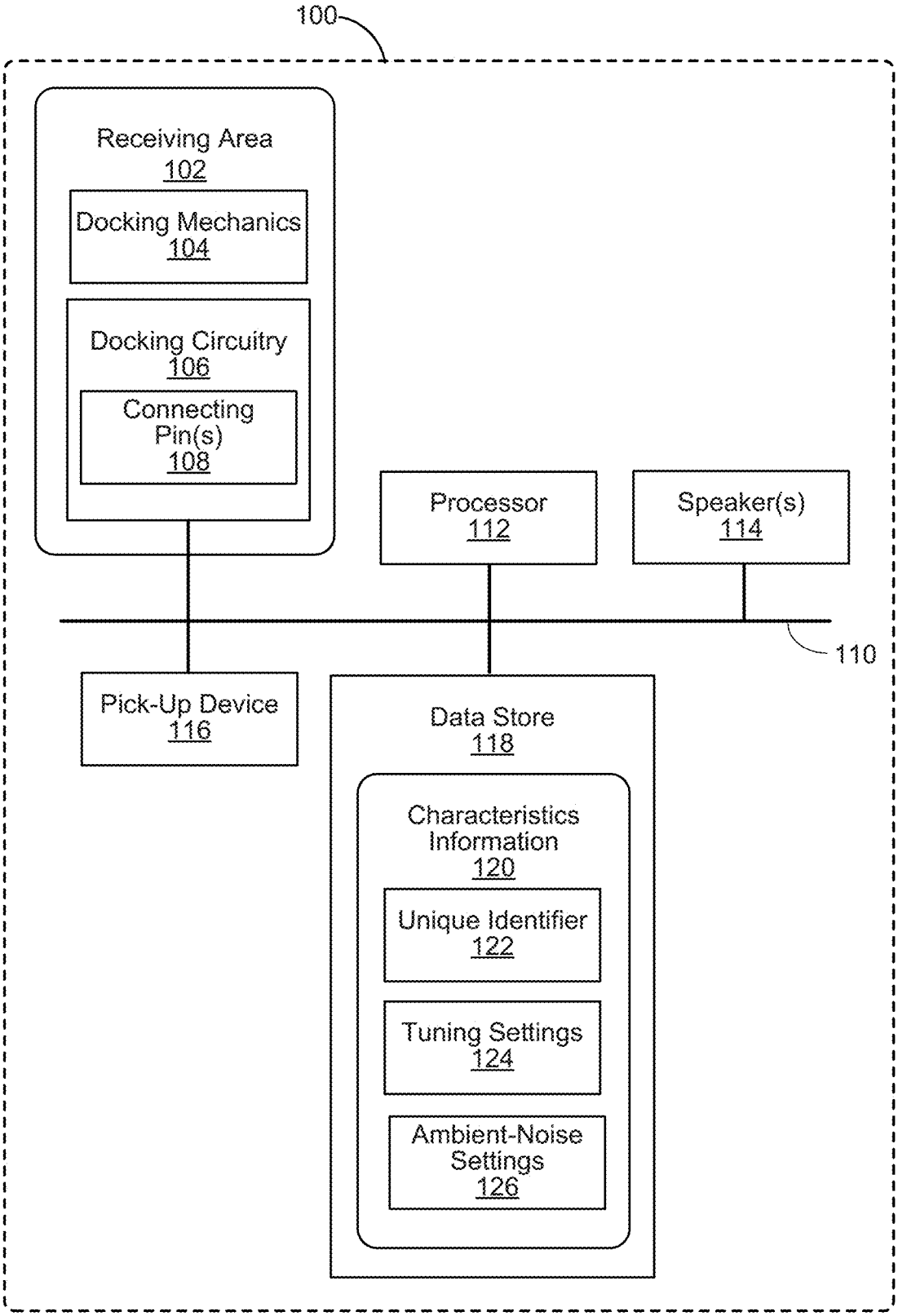
FIG. 4B is a block diagram of a follower headset, in accordance with an example of this disclosure.

FIG. 4B is a block diagram of a follower headset 100, in accordance with an example of this disclosure. The follower headset 100 has one or more earbud receiving areas 102 that can receive one or more wireless earbuds. Within the earbud receiving area 102, the follower headset 100 has docking mechanics 104, and circuitry 106 to properly hold the earbuds and communicate with them. The docking circuitry 106 can include one or more docking pins 108. The docking circuitry 106 is connected by a (follower) bus 110 to other components of the follower headset 100, including a (follower) processor 112, one or more (follower) speakers 114, an audio pickup device (e.g., microphone) 116 and an on-board memory (data store) 118. The on-board memory (data store) 118 can store characteristics information 120 associated with the follower headset 100. Such characteristics information can include a unique identifier (e.g., identification code) 122, tunings settings 124, ambient-noise (e.g., noise cancellation) settings 126, and the like. In some embodiments, characteristic information 120 includes whether the follower headset is monoaural or binaural.

In at least one example of this disclosure, when a headset 200, 204 (or an earbud 202, 206 thereof) is coupled to the follower headset 100, the headset (e.g., 200) will—based on the coupling—transmit information 120 concerning audio characteristics of the follower headset 100 to a wireless control pod 500.

Figure 5A:
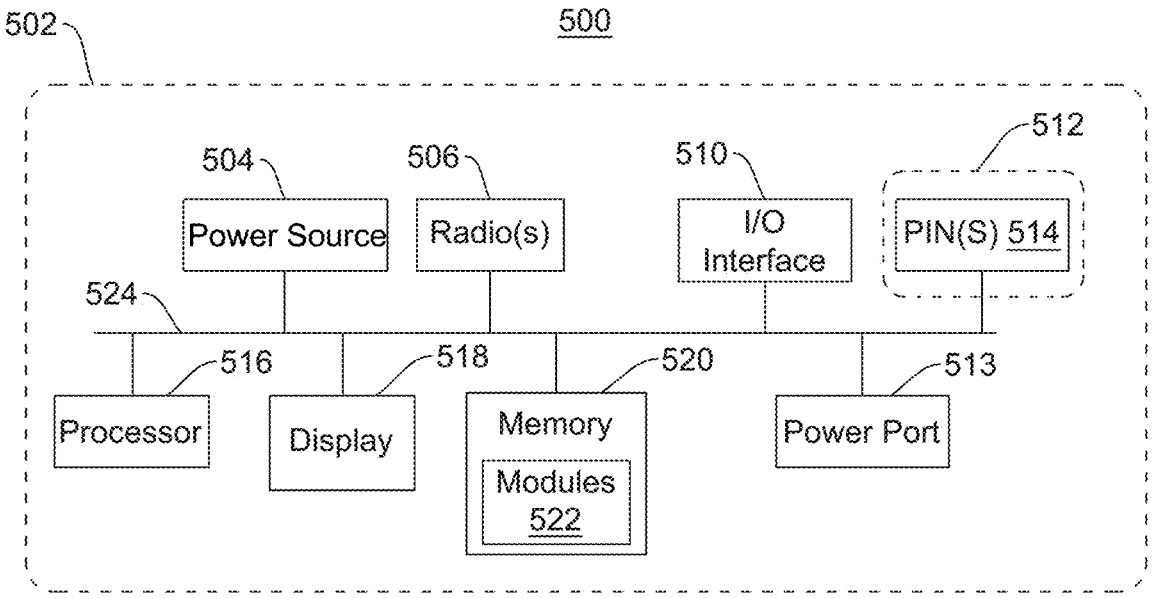
FIG. 5A is a block diagram of a wireless control pod, in accordance with an example of this disclosure.

FIG. 5A is a block diagram of a wireless control pod 500, in accordance with an example of this disclosure. Components of the wireless control pod 500 are housed within a housing 502. The wireless control pod 500 includes a power source 504 (e.g., a battery of rechargeable cells), and at least one radio 506 that can be used to communicate with one or more other electronic devices (such as a headset, a smart phone, or a computer). In some examples of the invention, the wireless control pod 500 can also house local area network (Wi-Fi™) connectivity technologies or wide area network (e.g., cellular) connectivity technologies. The wireless control pod 500 includes a user interface 510, which can include such items as one or more actuable buttons and a touchscreen. The housing 502 includes a headset-receiving area 512 comprising at least one pin 514, which can be used to connect one or more batteries of a headset (e.g., 200) to the power source 504. The wireless control pod 500 includes a power port 513 which can be used to couple the internal power source 504 to an external power source (e.g., mains power) to recharge the internal power source 504. The wireless control pod 500 also includes a processor 516 which is coupled to the power source 504, the radio(s) 506, and the user interface 510 through a bus 524. The wireless control pod 500 also includes a memory 520 which can store various follower headset-specific modules 522 which are executable by the processor 516 to control the functions of the remaining components and their interactions with each other, as would be understood by a person of skill. Memory 520 can also store audio data such as music and audio books. The housing 502 can store a headset (200, 204) when not in use. The wireless control pod 500 can charge batteries of a headset (200, 204) during storage.

Figure 5B:
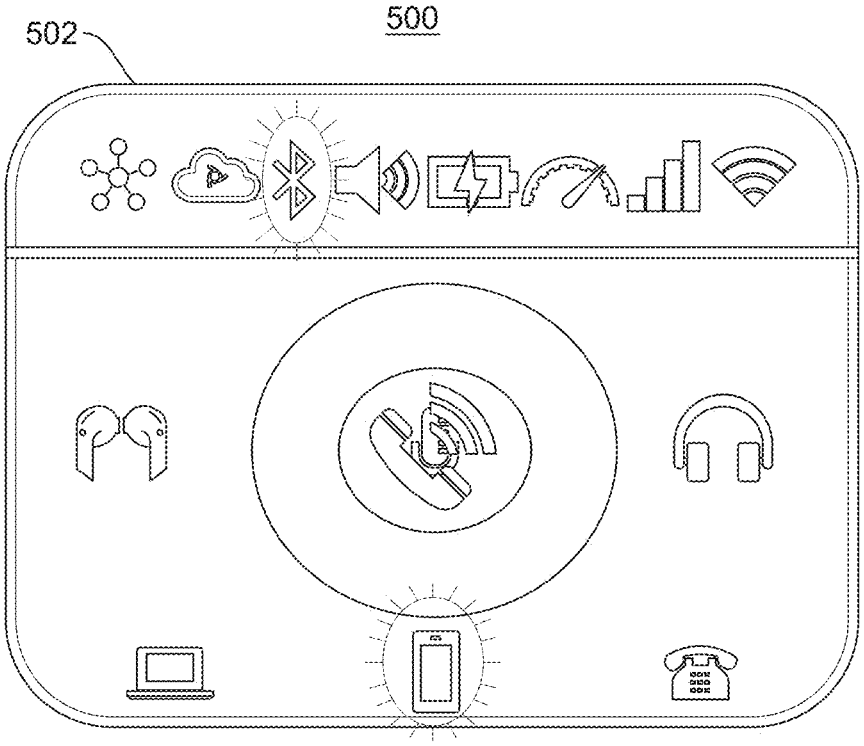
FIG. 5B illustrates a wireless control pod, in accordance with an example of this disclosure.

FIG. 5B shows an external view of the wireless control pod 500. Various indicators corresponding to various functions of the wireless control pod 500 are visible on the housing 502. The wireless control pod 500 and the headset 200, 204 to which it is wirelessly connected are configured to adapt to the form-factor in which they are used to provide a personalized and seamless user experience as well as a seamless audio experience. In some examples, because of the reduced physical constraints of the follower headset 100, additional electronics such as WAN connectivity technology, LAN connectivity technology, sensors, and acoustic safety circuitry can be incorporated into the wireless control pod 500. In some examples, the follower headset 100 contains only passive electronics. In such examples, unique identifier information, audio tuning information and other specifics of the follower headset are retrieved by the headset 200, 204 when docked with the follower headset 100. In some examples, the retrieved information is passed to the wireless control pod 500.

Figure 6A:
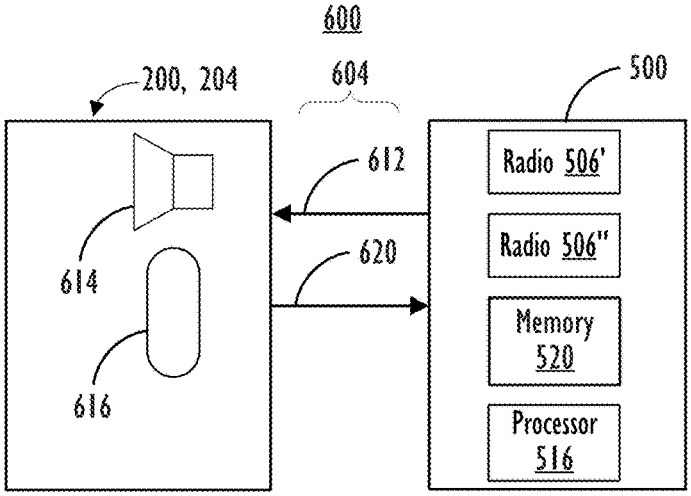
FIG. 6A is a block diagram of an operational environment of a control pod, in accordance with an example of this disclosure.

FIG. 6A is a block diagram of an operational environment 600 of a wireless control pod 500, in accordance with an embodiment of this disclosure. The wireless control pod 500 is in signal communication with a headset 200, 204 over a channel 604. The headset 200, 204 has been removed from the housing 502 of the wireless control pod 500. The headset 200, 204 can include one or more speakers 614 and one or more microphones 616. In at least one example of this disclosure, the speaker(s) 614 and microphone(s) 616 each comprise their own radio (not shown).

In the example embodiment of FIG. 6A, a radio 506 of the wireless control pod 500 is transmitting a data stream 612 over channel 604. The data stream 612 can contain audio data retrieved from memory 520 or received by another radio 506 of the wireless control pod 500 (e.g., from a router connected to the internet). One or more radios 506 of the wireless control pod 500 can be used to communicate with a local area network or a wide area network. The data stream 612 can contain audio data for broadcast by speaker 614 of the headset 200, 204. Transmission of the data stream 612 by the wireless control pod 500 can be paused or stopped when a user inputs an input at the user interface 510 (see FIG. 5A), such as by pressing a button or contacting a touch pad. In at least one example of this disclosure, the processor 516 can detect when the headset 200, 204 is coupled to the power source 504 through the pin 514 and can terminate the channel 604 in response to such detection.

In some examples of this disclosure, the wireless control pod 500 can also receive second data stream 620 over the channel 604, such as audio data captured using the microphone 616 of the headset 200, 204. In some examples, the wireless control pod 500 can store such audio in memory 520 for subsequent playback. In some examples of this disclosure, the wireless control pod 500 can control audio pick-up by the microphone(s) 616 and audio broadcasting by the speaker(s) 614 based on user inputs received at the user interfaces 510 or based on (user) voice commands detected using the microphone(s) 616 of the headset 200, 204.

In some examples of this disclosure, the processor 516 is operable to render information using the display 518, such as the charging status of a battery cell of the wireless headset 200, 204, or information about music being played by the headset 200, 204.

In at least one example, the wireless control pod 500 can receive second data stream 620 over the first channel 604, such as audio data captured using a microphone 616 of the wireless headset 200, 204, and pause transmission of the first data stream 612, responsive to receiving the second data stream 620. Furthermore, the processor 516 can be operable to detect a second input at the user interface 510 and thereafter reinitiate transmission over the first channel 604 responsive to detecting the second input.

Figure 6B:
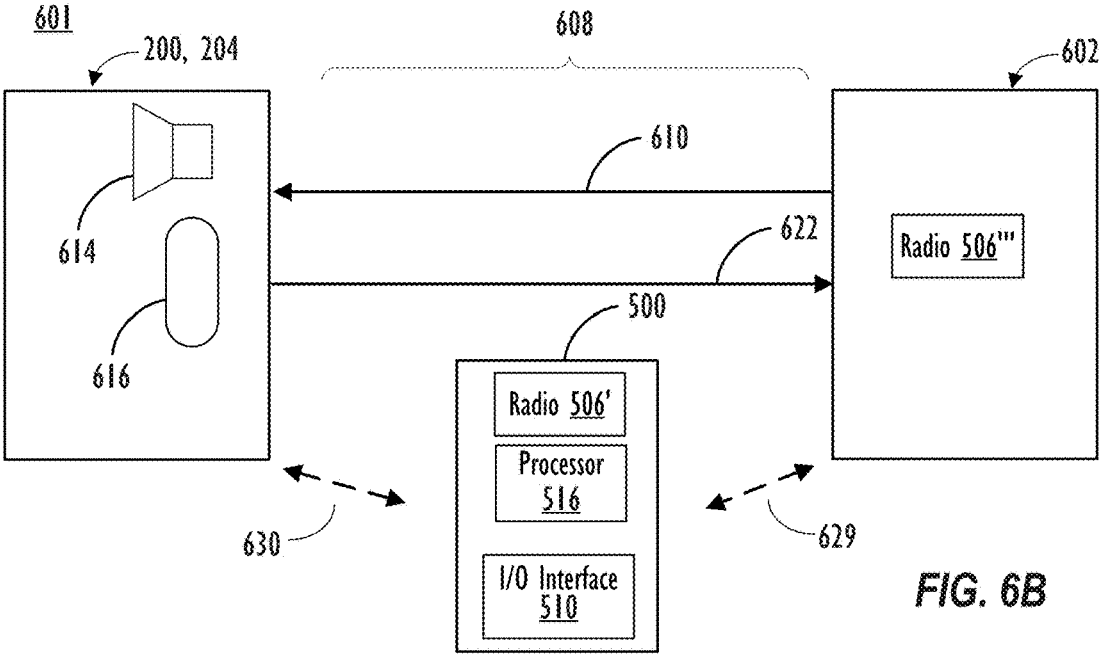
FIG. 6B is another block diagram of an operational environment of a wireless control pod, in accordance with an example of this disclosure.

FIG. 6B is a block diagram of an operational environment 601 of a wireless control pod 500, in accordance with an example of this disclosure. The wireless control pod 500 is in signal communication 629 with a smart device 602 (e.g., a smart phone), and in signal communication 630 with a headset 200, 204. In the example of FIG. 6B, a radio 506 of the wireless control pod 500 detects that a channel 608 has been established between the headset 200, 204 and the smart device 602. The headset 200, 204 is receiving a first data stream 610 from a radio 506 of the smart device 602 over the channel 608 and transmitting a second data stream 622 over the channel 608. The first data stream 610 can contain audio data, call information, and other information from the smart device 602. The first data stream 610 can contain audio data for broadcast by speaker 614 of the headset 200, 204. For example, music stored by the smart device 602 can be transmitted to the speaker(s) 614 over the channel 608. In some examples, transmission of such audio data (e.g., music) by smart device 602 can be paused or stopped when a user inputs an input at the user interface 510 of the wireless control pod 500. In at least one example of this disclosure, the processor 516 of the wireless control pod 500 can detect when the headset 200, 204 is coupled to the power source (504) through the pin 514 and will terminate the channel 608 in response.

In accordance with at least one example of this disclosure, the wireless control pod 500 is operable to: detect a decoupling of the wireless headset 200, 204 from the power source 504 at the pin 514; detect a coupling of the wireless headset 200, 204 with a smart device 602; detect a second input at the user interface 510; and initiate the channel 608 between the wireless headset 200, 204 and the smart device 602, in response to detecting the user input at the user interface 510.

In those examples in which the housing (502) houses a display (518) (e.g., coupled to the processor 516), the wireless control pod 500 can render information using the display 518 corresponding to audio data of the channel 608, such as information about music being (see e.g., FIG. 8) played or the identity of a caller to the smart device 602.

In some examples, the processor 516 is operable to cause the radio 506 of the smart device 602 to end transmission of the data stream 610 to the wireless headset 200, 204, in response to detecting a user input at the user interface 510, (e.g., a user presses a stop button.) In some examples, operations of the wireless control pod 500 can also be controlled through voice commands, such as those captured by a microphone 616 of the headset 200, 204.

In at least one example, the processor 516 is also operable to initiate audio pickup by a microphone 616 of the wireless headset 200, 204 for transmission to the smart device 602 over channel 608, in response to a user input at the user interface (510) or detection of a voice command captured using the microphone 616 of the headset 200, 204.

Figure 6C:
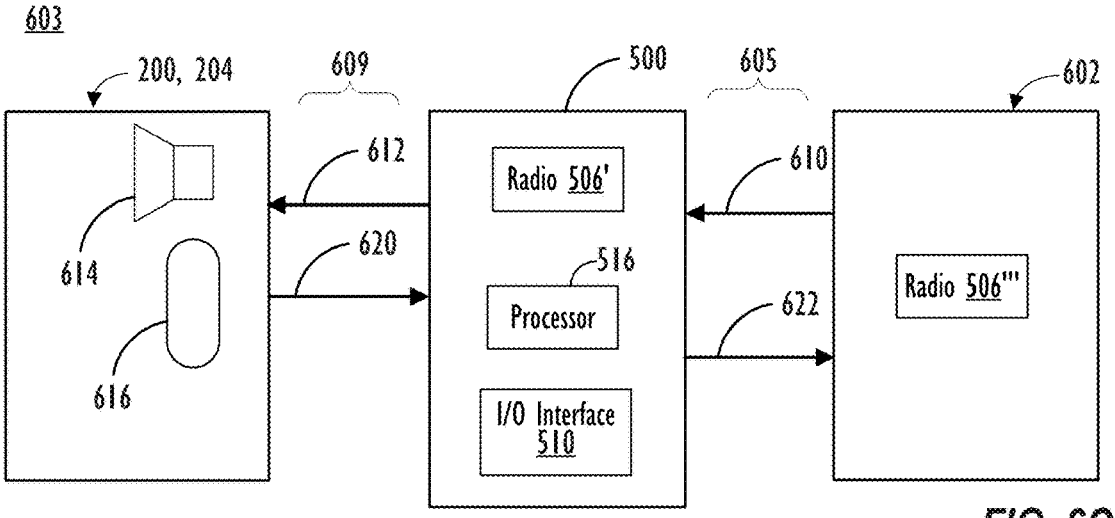
FIG. 6C is a third block diagram of an operational environment of a wireless control pod, in accordance with an example of this disclosure.

FIG. 6C is a block diagram of an operational environment 603 of a wireless control pod 500, in accordance with an example of this disclosure. The wireless control pod 500 is in signal communication with a smart device 602 (e.g., a smart phone) over a first channel 605, and in signal communication with a headset 200, 204 over a second channel 609. The headset 200, 204 can include one or more speakers 614 and one or more microphones 616. In at least one example of this disclosure, the speaker(s) 614 and microphone(s) 616 each comprise their own radio (not shown).

In the example of FIG. 6C, a radio 506 of the wireless control pod 500 is receiving a first data stream 610 from a radio 506 of the smart device over the first channel 605 and transmitting a second data stream 612 over the second channel 609 to a headset 200, 204. The first data stream 610 can contain audio data, call information, and other information from the smart device 602. The second data stream 612 can contain audio data for broadcast by speaker(s) 614. The audio data broadcast by the speaker(s) 614 can correspond to audio data of the first data stream 610. For example, music stored by the smart device 602 can be relayed to the speaker(s) 614 by the wireless control pod 500. In at least one example, relaying of such audio data (e.g., music) by the wireless control pod 500 can be paused or stopped when a user inputs an input at the user interface 510. In at least one example of this disclosure, the processor 516 can detect when the headset 200, 204 is coupled to the power source 504 through the pin 514 and can terminate the first channel 605 or the second channel 609 in response.

In some examples of this disclosure, the wireless control pod 500 can also receive a data stream 620 over the second channel 609, which can include audio data captured using the microphone 616 of the headset 200, 204. The wireless control pod can (using a radio 506) transmit third data stream 622 over the first channel 605 for transmission by a radio 506 of the smart device 602. The data stream 622 (which can include audio) sent to the smart device 602 can be based on the second data stream 620 from the headset 200, 204. In some examples of this disclosure, when the smart device 602 is a cell phone or a computer, the wireless control pod can control whether an incoming call to the smart device 602 is accepted by the smart device. In some examples of this disclosure, the wireless control pod 500 can control audio pick-up by the microphone(s) 616 and audio broadcasting by the speaker(s) 614.

In at least one example of this disclosure, the wireless control pod 500 can be used to control noise-cancelling operations of the of the speaker(s) 614 of the headset 200, 204.

In some embodiments, the wireless control pod 500 can control phone calls, control music playback and ambient noise settings of the headset 200, 204, or the follower headset 100 when the earbuds (202) of the headset 200, 204 are docked in the follower headset 100.

In at least one example of this disclosure, when a headset 200, 204 (or an earbud 202, 206 thereof) is coupled to a follower headset 100, the headset 200, 204 can—based on the coupling—transmit information concerning audio characteristics of the follower headset 100 to wireless control pod 500. In response, the wireless control pod 500 can alter characteristics (e.g., tonal spectrum) of the data stream (e.g., 610, 612) sent to the headset 200, 204, based on characteristics of the follower headset 100, (e.g., associated with a unique ID of the follower headset 100). The data stream can be altered such that the follower headset 100 is able to faithfully reproduce (render) audio of the data stream not renderable by the primary headset (200, 204), (e.g., render full stereo surround sound not reproducible by the earbuds 202, 206 of the headset 200, 204).

Figure 7:
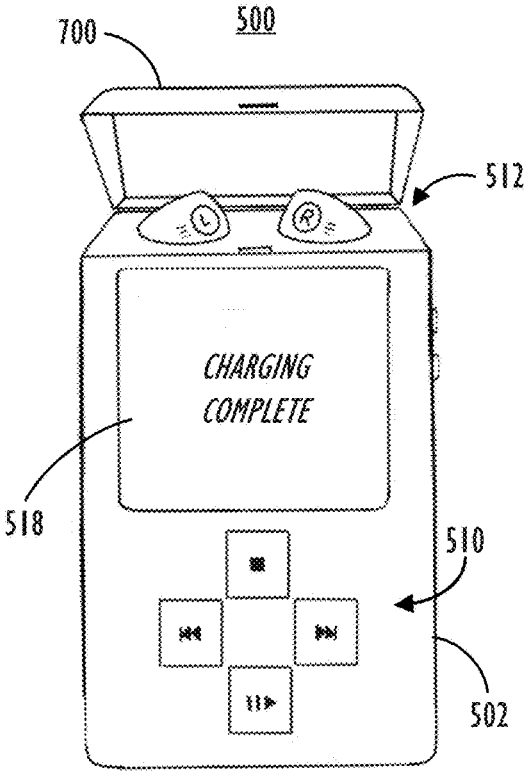
FIG. 7 illustrates a wireless control pod, in accordance with an example of this disclosure.

FIG. 7 illustrates a wireless control pod 500, in accordance with an example of this disclosure. The wireless control pod 500 is in an open configuration, in which a lid 700 of the housing 502 is raised to reveal the receiving area 512 for earbuds of a headset (200, 204). The user interface 510 contains several user-actuable buttons. The display 518 displays information concerning the charge status of the batteries of the headset 200, 204.

Figure 8:
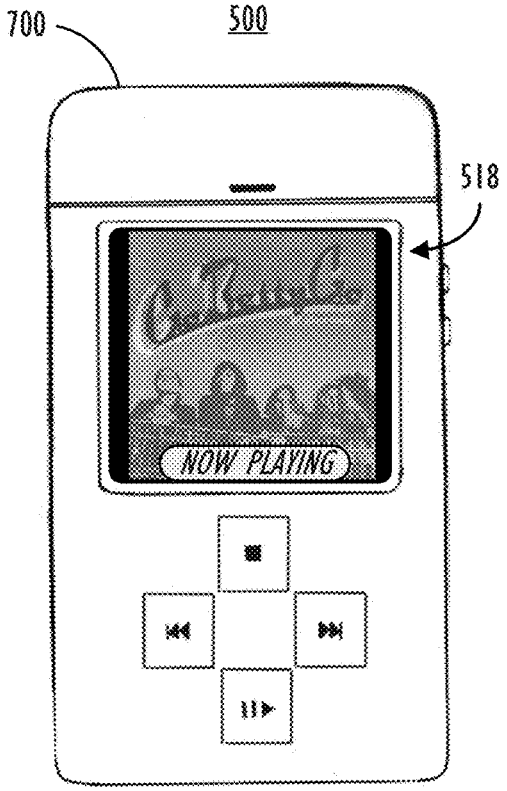
FIGS. 8-10 illustrate additional examples of a wireless control pod.

FIG. 8 illustrates a wireless control pod 500, in accordance with another example of this disclosure. In FIG. 8, the receiving area 512 of FIG. 7 is hidden by the closed lid 700. The display 518 displays information concerning the playback of music from a smart device (602), (e.g., being played by a headset 200, 204).

Figure 9:
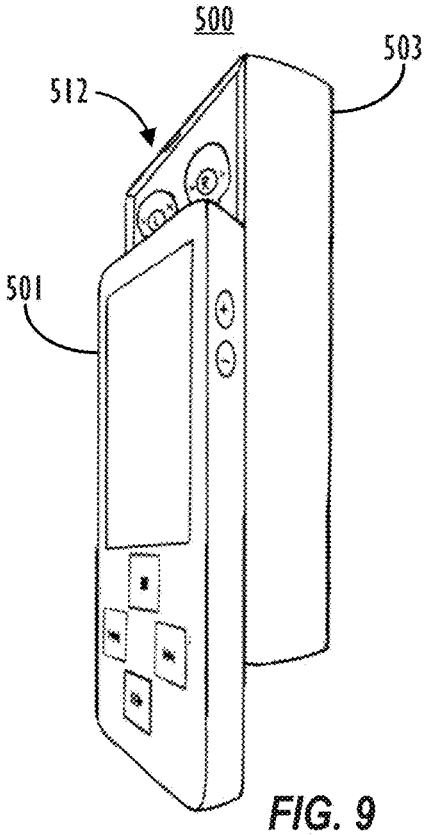

FIG. 9 illustrates a wireless control pod 500, in accordance with another example of this disclosure. In FIG. 9, the headset receiving area 512 is exposed by sliding an upper portion 501 of the wireless control pod 500 away from a lower portion 503.

Figure 10:
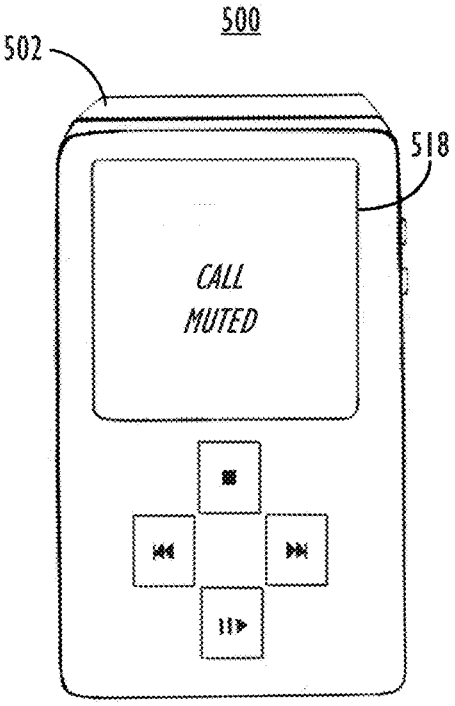

FIG. 10 illustrates a wireless control pod 500, in accordance with another example of this disclosure. In FIG. 10, the headset receiving area 512 of FIG. 9 is not visible because the housing 502 is closed.

In each of FIGS. 7-10, the housing 502 is operable to releasably retain the headset 200, 204 in the headset (earbud) receiving area 512 for charging by the power source 504 (e.g., a battery of rechargeable cells).

Figure 11:
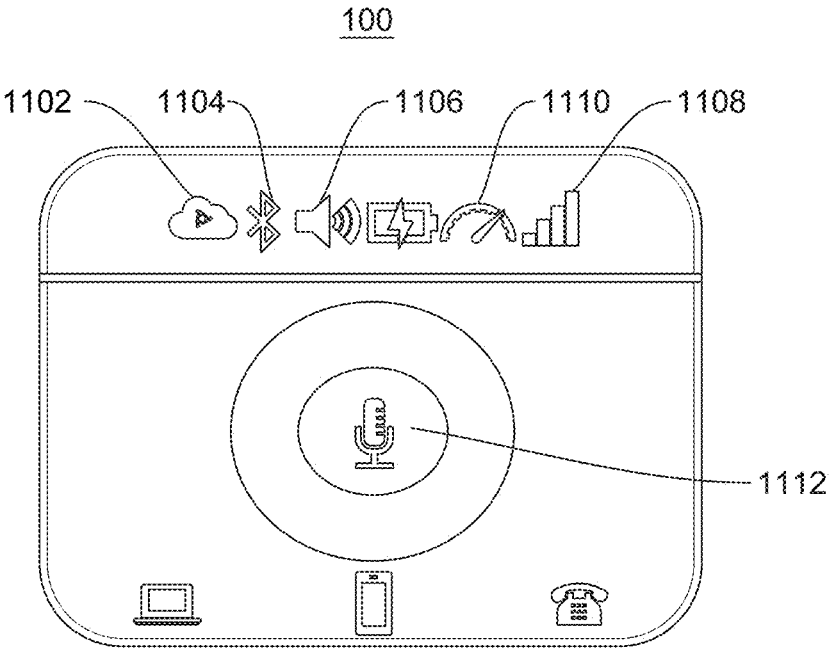
FIG. 11 illustrates functionalities of a wireless control pod, in accordance with an example of this disclosure.

FIG. 11 illustrates functionalities of a wireless control pod 500, in accordance with an example of this disclosure. The wireless control pod 500 can display information that is highly informative to the end-user and the information displayed can smartly adapt to the mode/system in which it is used. The wireless control pod 500, when equipped with cellular connectivity, can perform operations such as make and receive phone calls (via soft-phone clients installed in the Pod), stream music directly from cloud-based services and access information from the cloud. The wireless control pod 500 can display information indicating the wireless control pod 500 is connected to a cloud-based service 1102 or that the wireless control pod 500 is connected via Bluetooth (BT) 1104. The wireless control pod can also display information related to the volume of audio it is receiving 1106, and the strength of its cellular signal 1108. The wireless control pod 500 can indicate the level 1110 of background noise in its environment as measured by the earbuds and indicate 1112 whether a microphone (e.g., 616) of a coupled device (e.g., 200) muted.

Figure 12A:
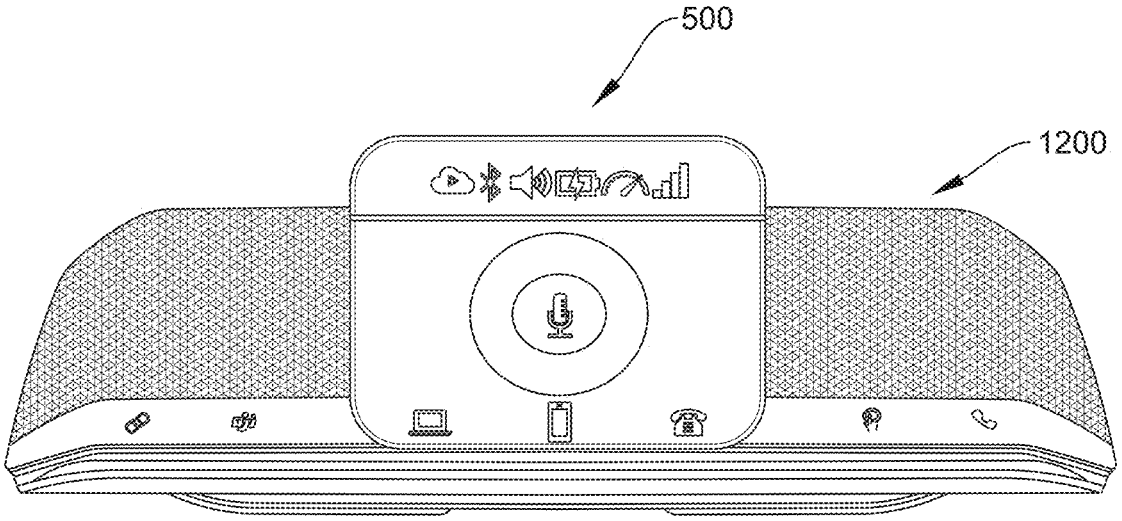
FIG. 12A illustrates a wireless control pod docked with a speaker phone, in accordance with an example of this disclosure.

FIG. 12A illustrates a wireless control pod 500 docked with a speaker phone 1200. While the wireless control pod 500 can incorporate the components discussed, such as a user interface and display (not shown), the speaker phone 1200 is a relatively simple device (not unlike a laptop docking station). The speaker phone 1200 can serve as an interface to a personal computer for soft-phone calls. The speaker phone can serve as an interface to a desk-phone. The speaker phone 1200 can serve as an interface to an enterprise-grade mono-aural or binaural digital enhanced cordless telecommunications headset (DECT) or Bluetooth headset dockable with a base, (see FIG. 13). Such configuration provides the end-user the flexibility to terminate calls originating from any of multiple telephony interfaces (e.g., soft, hard, mobile) using either the earbuds (e.g., 202) or enterprise-grade DECT/BT headset that is docked to the speaker phone 1200.

Figure 12B:
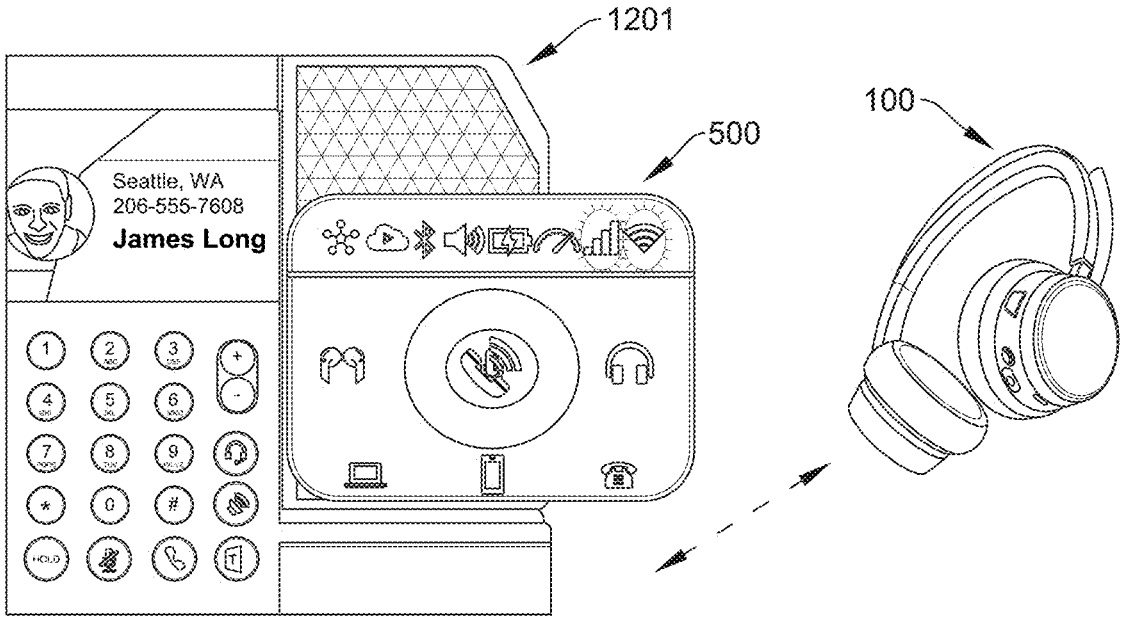
FIG. 12B illustrates a wireless control pod docked with a phone station, in accordance with an example of this disclosure.

FIG. 12B illustrates a wireless control pod 500 docked with a mobile phone station 1201 which is in signal communication with a follower headset 100. The wireless control pod 500 can be used to control volume and other functions of the follower headset 100 as well as display other information, as described above.

Figure 12C:
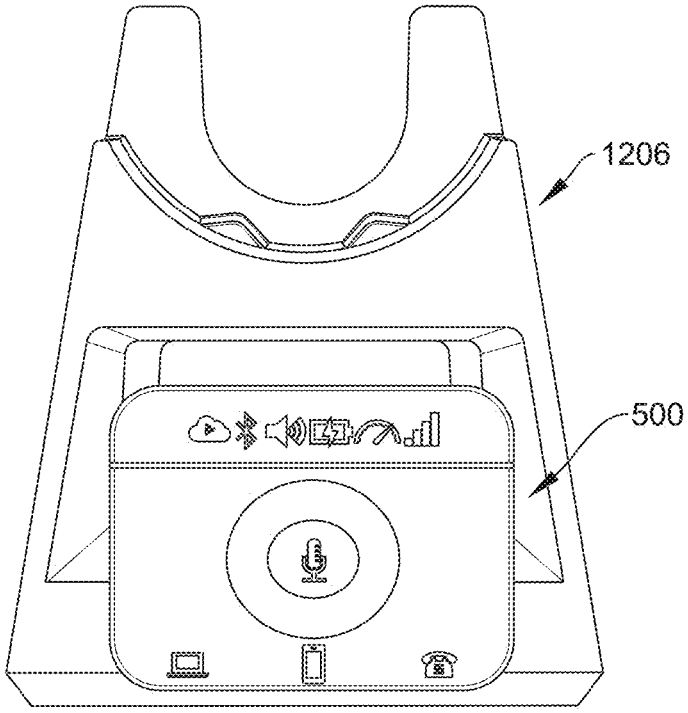
FIG. 12C illustrates a wireless control pod docked with a multi-interface base station, in accordance with an example of this disclosure.

FIG. 12C illustrates a wireless control pod docked with a multi-interface base station 1206. The wireless control pod 500 can be used to control volume and other functions of a headset (e.g., 100, 200, 204) that can be stored at the multi-interface base 1206, as well as display other information, as described at length above.

Figure 13:
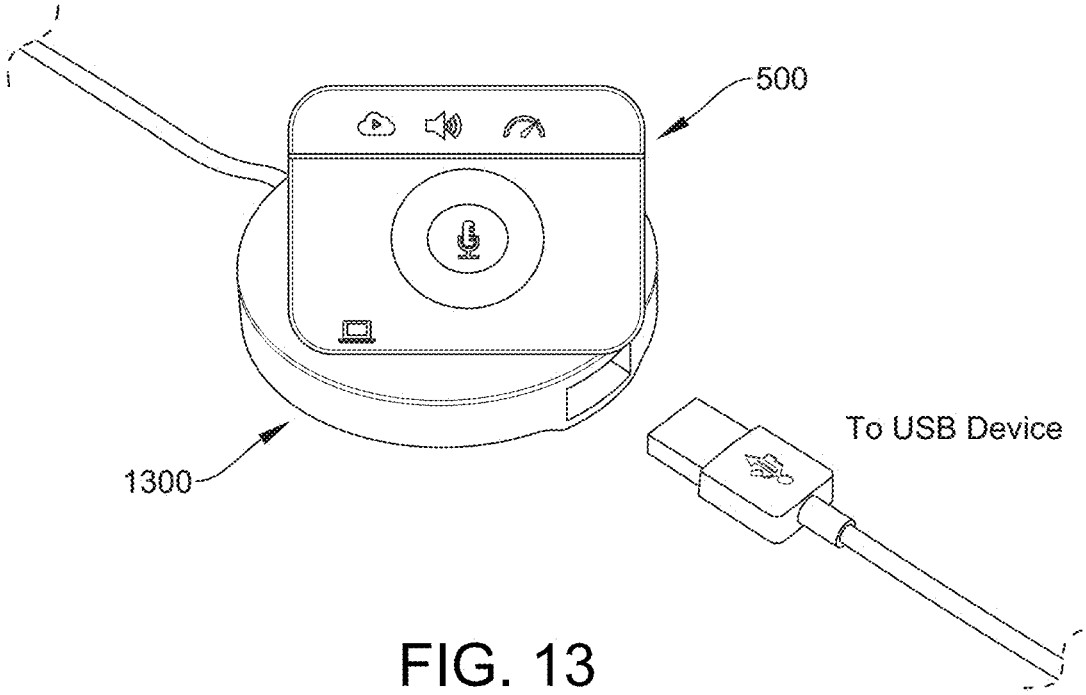
FIG. 13 illustrates a wireless control pod being used to control functions of a USB connected device, in accordance with an example of this disclosure.

FIG. 13 illustrates a wireless control pod 500 being used to control functions of a USB connected device (e.g., headset 200, 204 (not shown)). In FIG. 13, the wireless control pod 500 is docked into a puck 1300 of a USB controller. As in the multi-interface base use-case (1206), the wireless control pod 500 holds all the electronics that would conventionally be included in an enterprise USB headset puck. In this situation, a user can use either the earbuds (e.g., 202) or the wireless control pod 500 to terminate a connection between a mobile device or other device paired to the puck.

Figure 14:
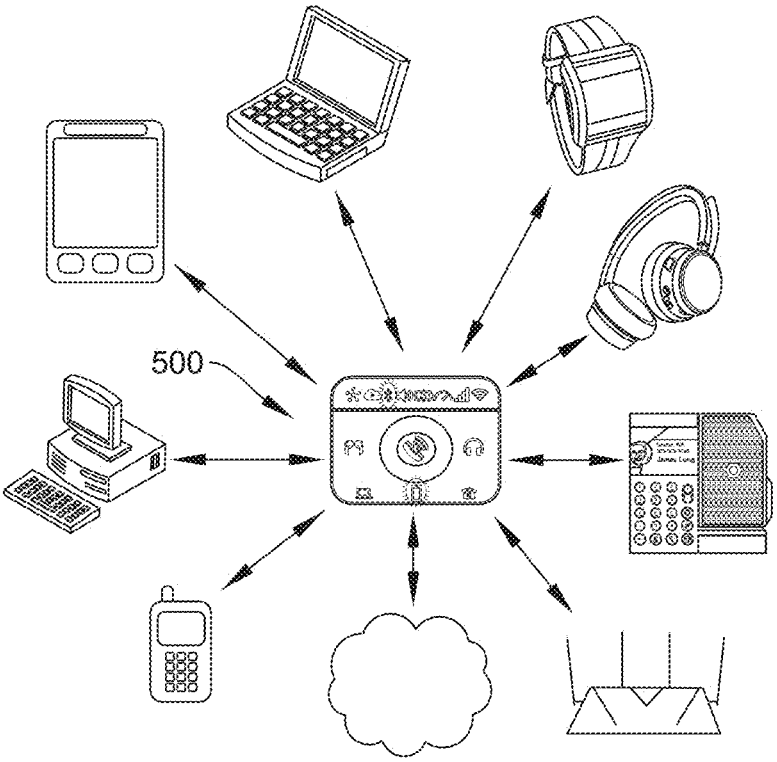
FIG. 14 illustrates a wireless control pod serving as an intermediary for multiple external devices, in accordance with an example of this disclosure.

FIG. 14 illustrates a wireless control pod 500 serving as an intermediary for multiple external devices. The wireless control pod 500 can connect one or more wireless devices and control various aspects of the communications between them, depending on how the wireless control pod 500 is configured, (e.g., FIGS. 6A-6C).

Figure 15:
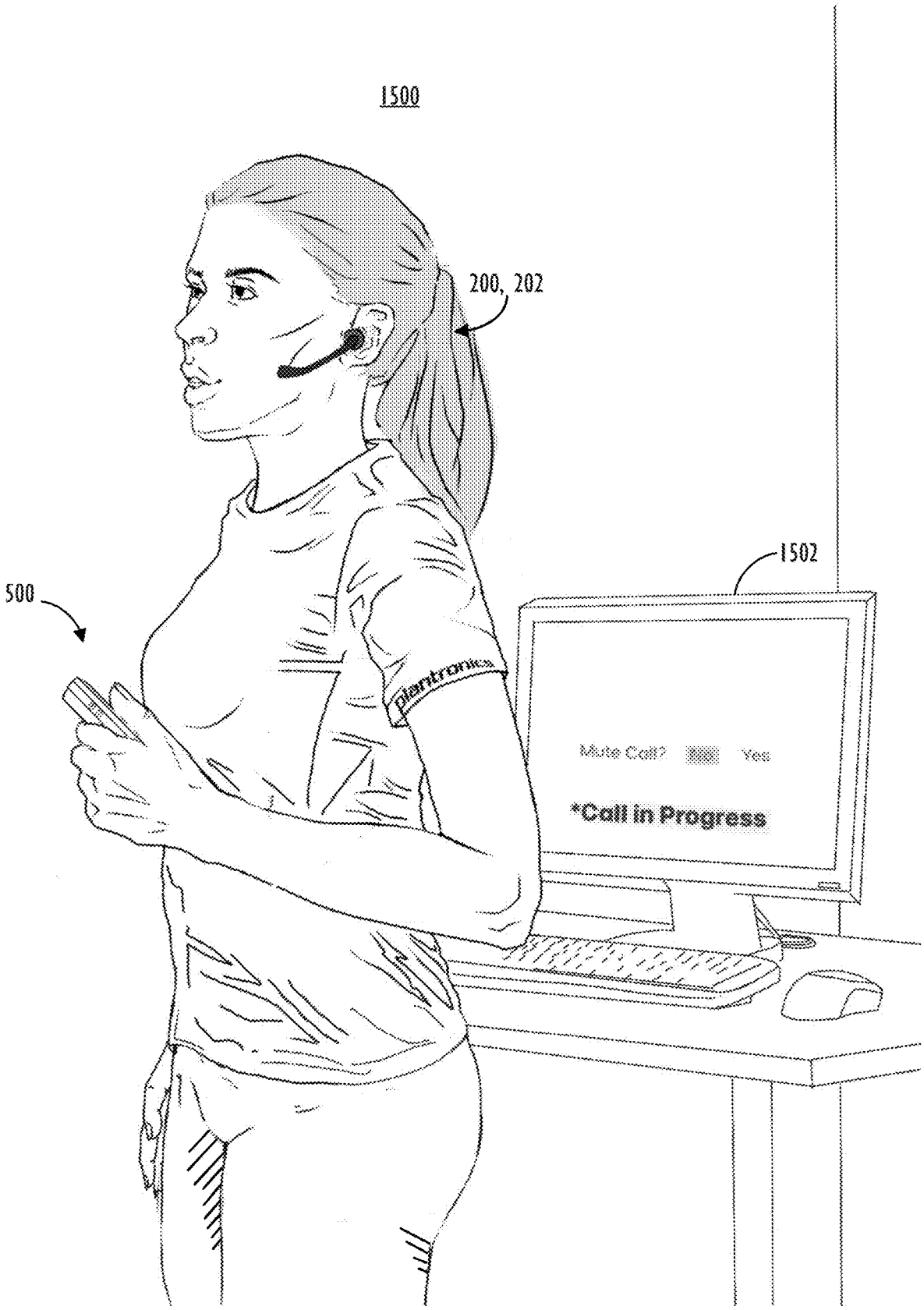
FIG. 15 illustrates an operational environment of a wireless control pod, in accordance with an example of this disclosure.

FIG. 15 illustrates an operational environment 1500 of a wireless control pod 500, in accordance with an example of this disclosure. In FIG. 15, a user is on a call received through her computer 1502. She can mute and unmute the call by simply pressing a button on her wireless control pod 500. She does not have to maintain eye contact with her computer 1502 to know if she is muted, nor does have to search for call controls using a mouse or keyboard.

Figure 16:
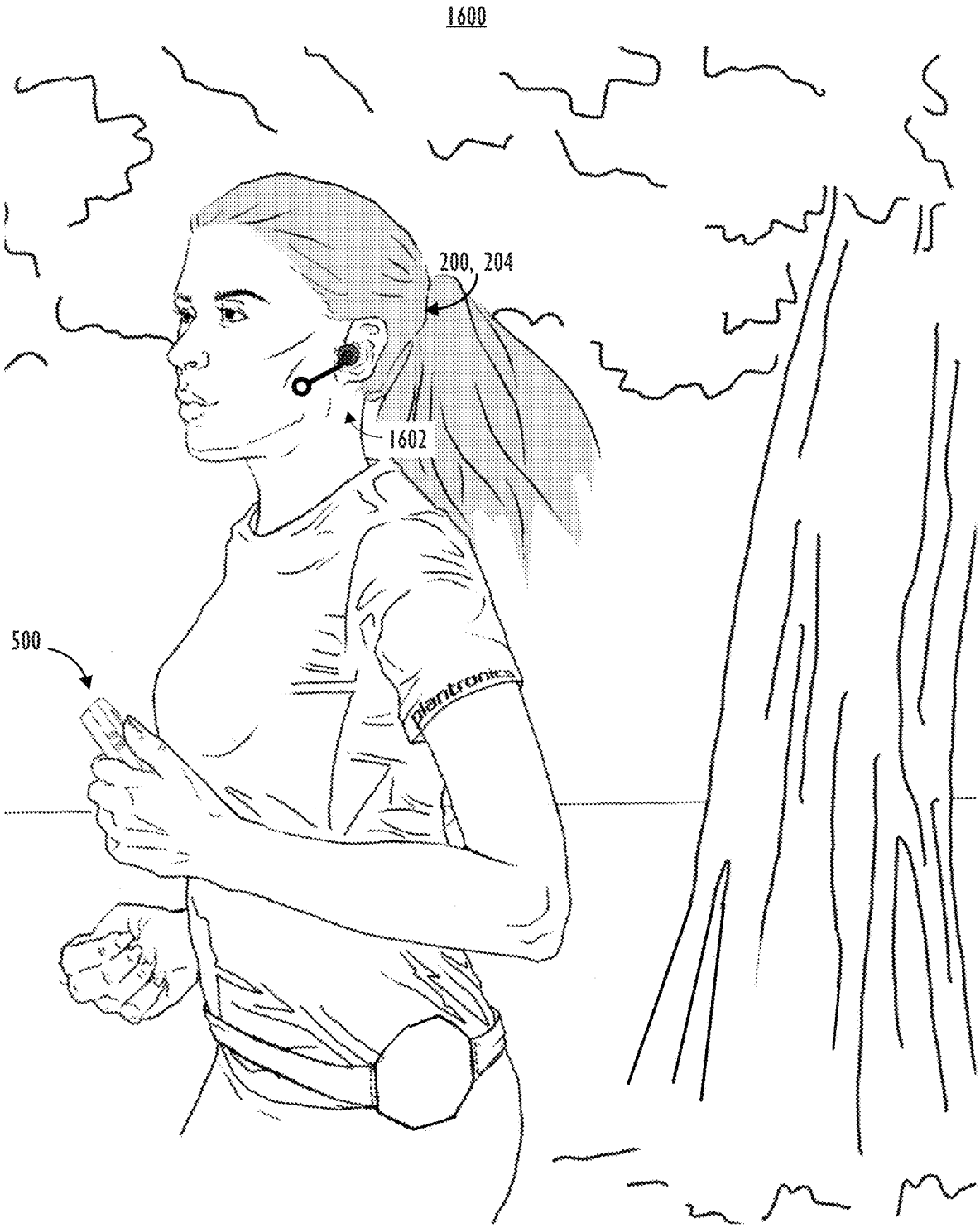
FIG. 16 illustrates another operational environment of a wireless control pod, in accordance with an example of this disclosure.

FIG. 16 illustrates another operational environment 1600 of a wireless control pod 500, in accordance with an example of this disclosure. In FIG. 16, the user can control playback of music to her headset 200, 204 from her wireless control pod, or if the wireless control pod 500 is configured with telephonic functions, the wireless control pod 500 can send audio from a phone call to the headset 200, 204 and receive conference audio from a microphone 1602 (e.g., 616) of the headset 100, 204.

Figure 17:
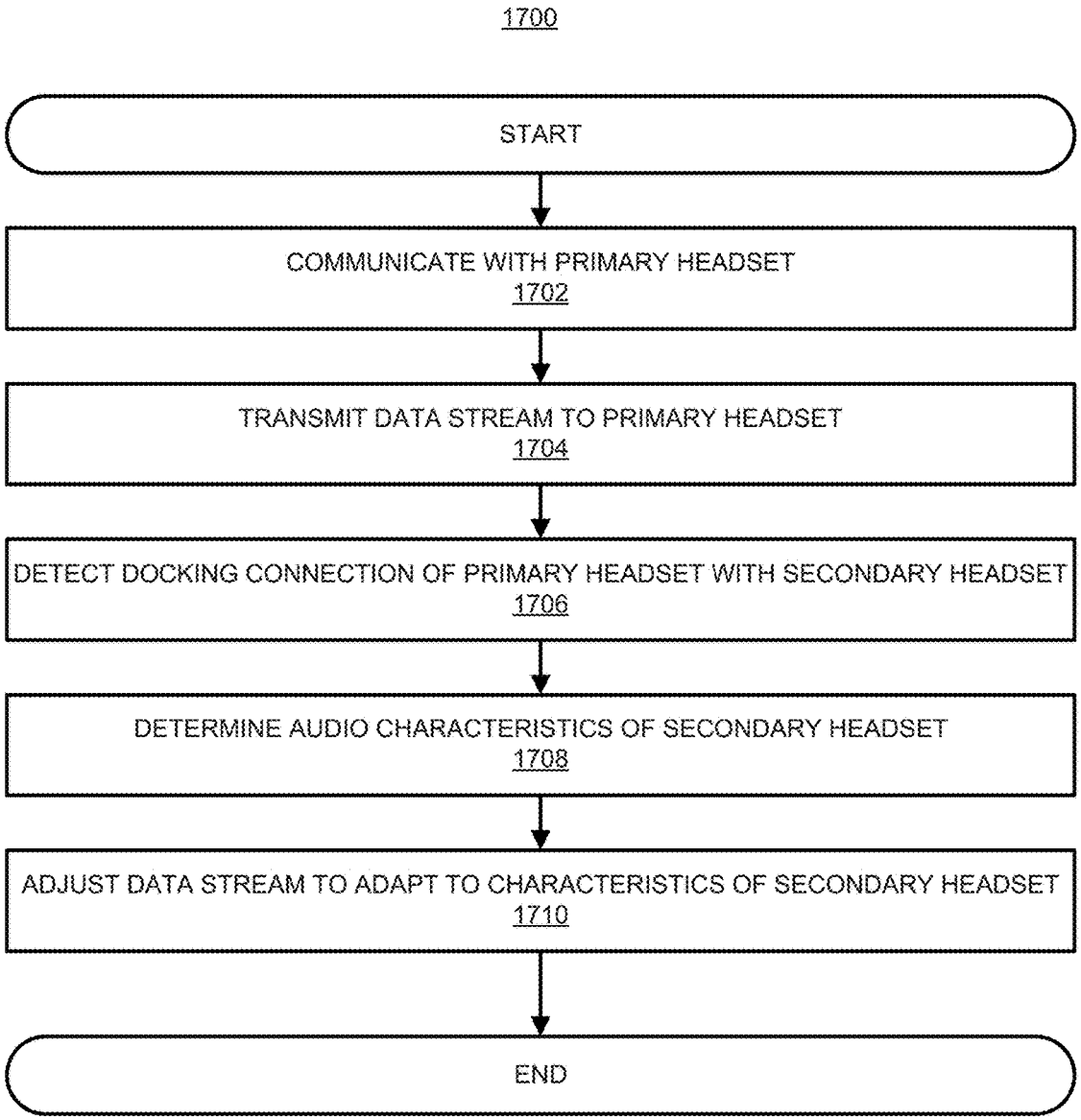
FIG. 17 illustrates a method of operating a wireless control pod, in accordance with an example of this disclosure.

FIG. 17 illustrates a method 1700 of operating the wireless control pod 500. The method 1700 includes communicating 1702 with a headset (e.g., 200) over a channel (e.g., 604) using one or more radios (e.g., 506) of the wireless control pod 500. When the wireless control pod 500 is in communication with the headset (200)— which can comprise one or more earbuds (e.g., 202)— the wireless control pod 500 transmits 1704 a data stream (e.g., 612) over the channel (604) containing audio data for broadcast by one or more speakers (e.g., 614) of the headset 200. When one or more earbuds of the headset (200) docks into a receiving area (e.g., 102) of a secondary headset (e.g., 100), the wireless control pod 500 detects 1706 the docking connection. In response to detecting 1706 the connection, the wireless control pod 500 determines 1708 audio characteristics of the secondary headset using on or more of the earbuds (202). The wireless control pod 500 adjusts 1710 the data stream (612) to adapt to the determined audio characteristics of the secondary headset to enable the one or more speakers of the secondary headset to faithfully reproduce the audio data of the data stream.

The various examples within this disclosure are provided by way of illustration and should not be construed to limit the scope of the disclosure. Various modifications and changes can be made to the principles and examples described herein without departing from the scope of the disclosure and without departing from the claim which follows.

It is claimed:

1. A wireless control pod, comprising:

one or more radios;

a memory; and a processor coupled to the one or more radios and the memory, wherein the processor is operable to:

communicate with a headset over a channel using at least one of the one or more radios;

transmit a data stream over the channel containing audio data for broadcast by one or more speakers of the headset, the audio data based on data stored by the memory or received using at least one of the one or more radios;

detect a docking connection of one or more earbuds of the headset to a secondary headset;

determine audio characteristics of the secondary headset through at least one of the one or more earbuds of the headset, responsive to the detection; and adjust the data stream to adapt to the determined audio characteristics of the secondary headset to enable one or more speakers of the secondary headset to faithfully reproduce the audio data of the data stream.

2. The wireless control pod of claim 1, wherein determining audio characteristics of the secondary headset comprises determining a unique identification code of the secondary headset.

3. The wireless control pod of claim 1, wherein determining audio characteristics of the secondary headset further comprises determining tuning settings of the secondary headset.

4. The wireless control pod of claim 3, wherein determining audio characteristics of the secondary headset further comprises determining that the secondary headset is monoaural.

5. The wireless control pod of claim 3, wherein determining audio characteristics of the secondary headset further comprises determining that the secondary headset is binaural.

6. The wireless control pod of claim 3, wherein determining audio characteristics of the secondary headset further comprises determining ambient noise settings of the secondary headset.

7. The wireless control pod of claim 1, wherein faithfully reproducing the audio data of the data stream comprises rendering full stereo surround sound not renderable by the one or more earbuds of the headset.

8. A non-transitory computer readable medium storing instructions executable by a processor, wherein the instructions comprise instructions to:

communicate with a headset over a channel using one or more radios;

transmit a data stream over the channel containing audio data for broadcast by one or more speakers of the headset, the audio data based on data stored by a memory or received using at least one of the one or more radios;

detect a docking connection of one or more earbuds of the headset to a secondary headset;

determine audio characteristics of the secondary headset through at least one of the one or more earbuds of the headset, responsive to the detection; and adjust the data stream to adapt to the determined audio characteristics of the secondary headset to enable one or more speakers of the secondary headset to faithfully reproduce the audio data of the data stream.

9. The non-transitory computer readable medium of claim 8, wherein the instructions to determine audio characteristics of the secondary headset comprise instructions to determine a unique identification code of the secondary headset.

10. The non-transitory computer readable medium of claim 8, wherein the instructions to determine audio characteristics of the secondary headset further comprise instructions to determine tuning settings of the secondary headset.

11. The non-transitory computer readable medium of claim 10, wherein the instructions to determine audio characteristics of the secondary headset further comprise instructions to determine that the secondary headset is monoaural.

12. The non-transitory computer readable medium of claim 10, wherein the instructions to determine audio characteristics of the secondary headset further comprise instructions to determine that the secondary headset is binaural.

13. The non-transitory computer readable medium of claim 10, wherein the instructions to determine audio characteristics of the secondary headset further comprise instructions to determine ambient noise settings of the secondary headset.

14. The non-transitory computer readable medium of claim 8, wherein faithfully reproducing the audio data of the data stream comprises rendering full stereo surround sound not renderable by the one or more earbuds of the headset.

15. A method of operating a wireless control pod, the method comprising:

communicating with a headset over a channel using one or more radios of the wireless control pod;

transmitting a data stream over the channel containing audio data for broadcast by one or more speakers of the headset;

detecting a docking connection of one or more earbuds of the headset to a secondary headset;

determining audio characteristics of the secondary headset through at least one of the one or more earbuds of the headset, responsive to the detection; and adjusting the data stream to adapt to the determined audio characteristics of the secondary headset to enable one or more speakers of the secondary headset to faithfully reproduce the audio data of the data stream.

16. The method of claim 15, wherein determining audio characteristics of the secondary headset comprises determining a unique identification code of the secondary headset.

17. The method of claim 15, wherein determining audio characteristics of the secondary headset further comprises determining tuning settings of the secondary headset.

18. The method of claim 17, wherein determining audio characteristics of the secondary headset further comprises determining that the secondary headset is monoaural.

19. The method of claim 17, wherein determining audio characteristics of the secondary headset further comprises determining that the secondary headset is binaural.

20. The method of claim 17, wherein determining audio characteristics of the secondary headset further comprises determining ambient noise settings of the secondary headset.

* * * * *